United States Patent [19]

Miller, Jr.

[11] 4,249,701

[45] Feb. 10, 1981

[54] WASTE PULPING APPARATUS

[75] Inventor: Blaine M. Miller, Jr., Malvern, Pa.

[73] Assignee: Somat Corporation, Pomeroy, Pa.

[21] Appl. No.: 39,643

[22] Filed: May 16, 1979

[51] Int. Cl.[3] ..... B02C 13/286

[52] U.S. Cl. ..... 241/46.17; 241/74

[58] Field of Search ..... 241/46 B, 46 R, 46.11, 241/46.17, 46.08, 74, 222, 278 R

[56] References Cited

U.S. PATENT DOCUMENTS

| | | | |
|---|---|---|---|
| 2,583,997 | 1/1952 | Chester | 241/46.11 |
| 2,784,914 | 3/1957 | Powers | 241/46.11 |
| 3,844,488 | 10/1974 | Neitzel | 241/46.17 X |
| 3,885,745 | 5/1975 | Hankes et al. | 241/46.11 |

FOREIGN PATENT DOCUMENTS

| | | | |
|---|---|---|---|
| 1104661 | 4/1961 | Fed. Rep. of Germany | 241/46.17 |

*Primary Examiner*—Mark Rosenbaum
*Attorney, Agent, or Firm*—Kane, Dalsimer, Kane, Sullivan and Kurucz

[57] ABSTRACT

An apparatus for the pulping of waste material is disclosed including a tank, an impeller, a slurry chamber, and a discharge pipe for removal of slurry from the chamber. A flow directing device is provided within the chamber for increasing the flow into the discharge pipe. The device is appropriately positioned and shaped so that it will deflect the slurry from its rotational flow in the chamber to the discharge pipe. If the impeller is positioned horizontally at the bottom of the tank, it is preferably positioned off-center so waste material will not directly impinge upon the cutting surfaces when added to the tank. If the impeller is vertically oriented, the tank may be mounted on shock absorbers or resilient legs to minimize vibration.

14 Claims, 7 Drawing Figures

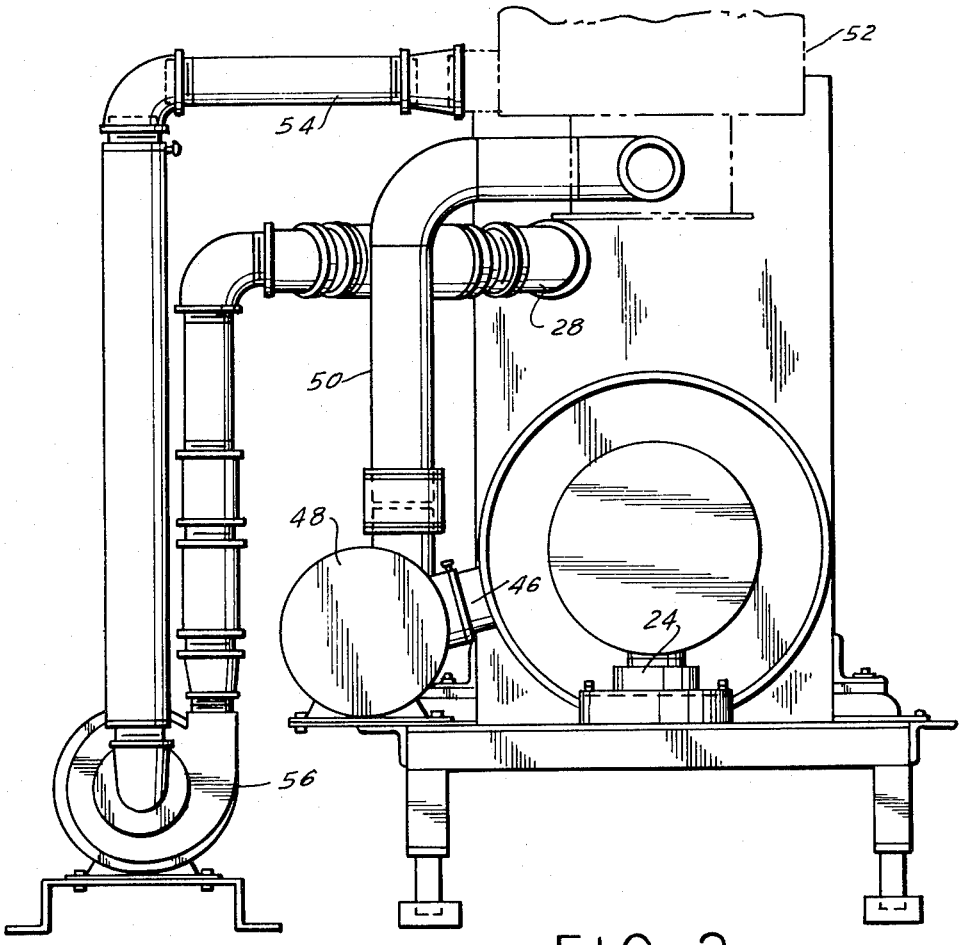
FIG. 2
FIG. 7
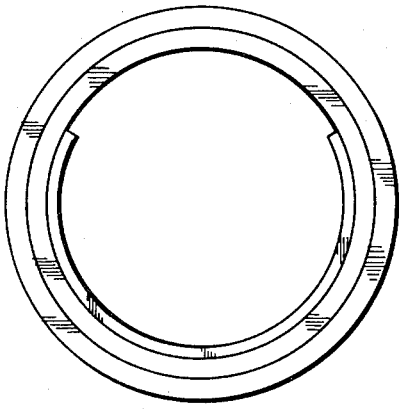

WASTE PULPING APPARATUS

BACKGROUND OF THE INVENTION

The field of the invention relates to waste pulping equipment for waste treatment and disposal.

In equipment of this type, waste materials are introduced into an impeller-created vortex of water, reduced to a pulp, and passed on to a water extraction device with the excess water separated and returned to the pulper for reuse. Such waste pulping machines are often provided with blades or cutting members mounted to the impeller to provide a shearing action as the impeller rotates. The blades also enable the pulping equipment to handle a quantity of non-pulpable material, such as plastic, which generally constitutes a minor portion of the waste to be disposed.

When introducing waste material into the tank of a pulping machine, such potentially damaging materials as silverware or bottle caps could damage the impeller. Horizontally disposed impellers are inherently subject to such damage. Vertically disposed impellers are not, but vibration problems have limited their utility. This is due to cavitation, i.e., the formation of air pockets in the slurry chamber. Providing a water level which is higher than the level of the impeller has been suggested as a solution in commonly assigned Ser. No. 714,609 filed Aug. 16, 1976, now abandoned, but efficiency of the apparatus is reduced to an extent. Another problem with this method is that floatables such as styrofoam will not be pulped due to their flotation above the impeller.

Another desirable feature of pulpers is to maximize the throughput of water and waste from the pulper to the extractor. Due to the fact that the rotating slurry within the pulper has inertia, simply attaching a discharge pipe to the walls of the slurry chamber does not provide for optimal throughput.

SUMMARY OF THE INVENTION

The invention is directed to a pulping system which combines high efficiency with little possible damage to the impeller. It also minimizes the effects of possible vibrations within the pulping tank.

In accordance with these objectives together with the desire to produce an economical and reliable apparatus, a pulper has been designed with a number of novel and advantageous features.

To increase throughput, a device is provided to direct the slurry, which is normally rotating in vertical motion within the chamber, to a discharge pipe. The device is preferably shaped as a scoop so that it deflects the flow of the liquid without acting as a significant obstruction. The tank and slurry chamber are substantially cylindrical to promote radial flow and provide economical operation. It has found that throughput increases by up to a factor of four in pulpers utilizing horizontally disposed impellers when the scoop is employed.

To minimize or even eliminate potential damage to the impeller due to the introduction of silverware or other material to the tank, two possible solutions are provided. The first has been suggested in the art, and involves the use of a vertically mounted impeller. It is readily appreciated that material introduced at the top of the pulper tank will not directly impinge upon the impeller and can therefore do it little harm. A second possible solution concerns the use of an impeller which is located off-center relative to the axis of a substantially cylindrical tank. A relatively large area for introducing waste is accordingly provided on one side of the tank where potentially damaging materials may be trapped before they can reach the impeller. A shield may be provided to protect the impeller from waste material introduced from the top of the tank and to provide an opening where waste can be safely introduced.

If a vertical impeller is utilized, the apparatus is mounted upon mechanical isolators. In this manner, the effects of the vibrations are minimized.

BRIEF DESCRIPTION OF THE DRAWINGS

FIG. 2 is a rear view of the apparatus shown in FIG. 1;

FIG. 7 is a front view of the pipe and scoop assembly shown in FIG. 6.

DETAILED DESCRIPTION OF THE INVENTION

Figure 1:
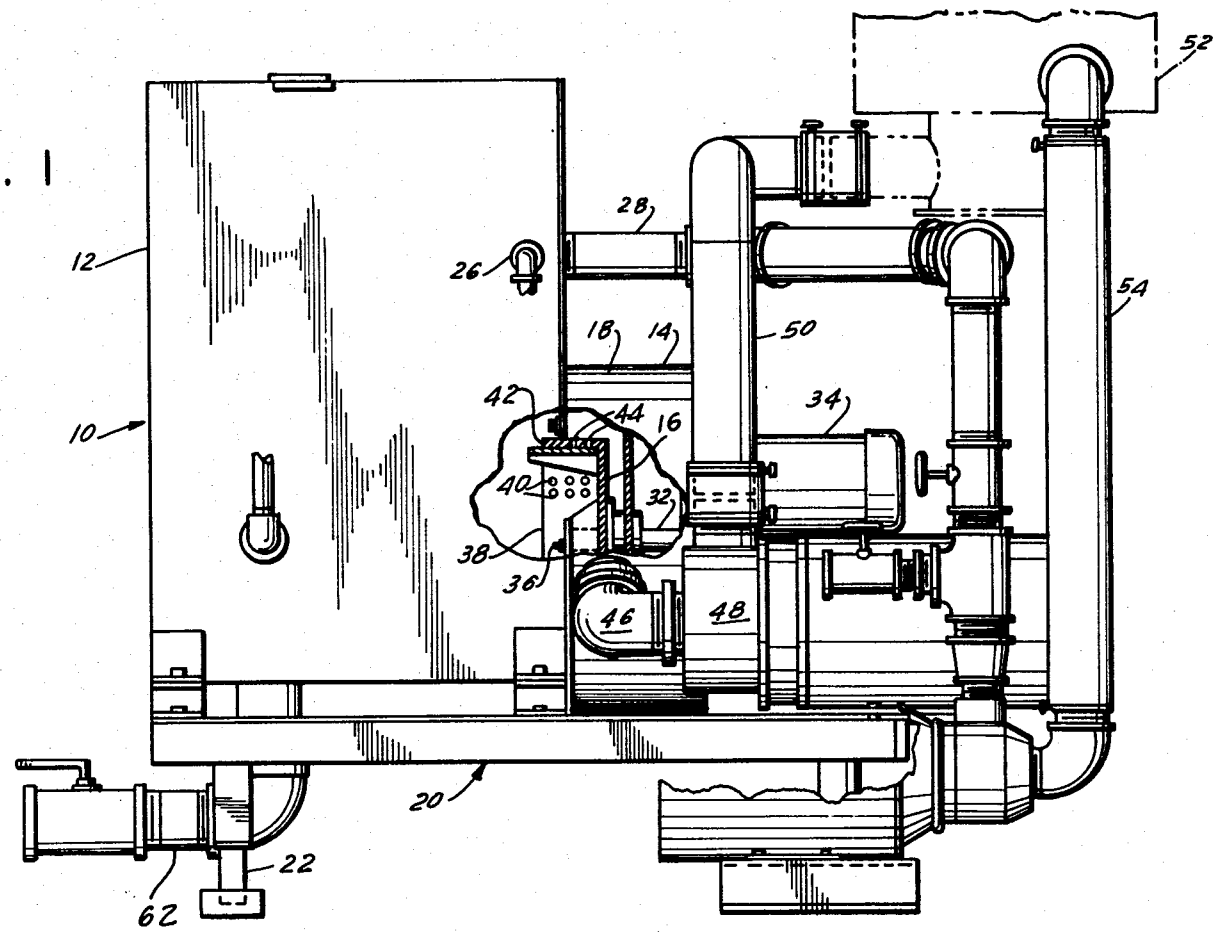
FIG. 1 is a side elevation view of a waste pulping apparatus having a vertically mounted impeller.
Figure 3:
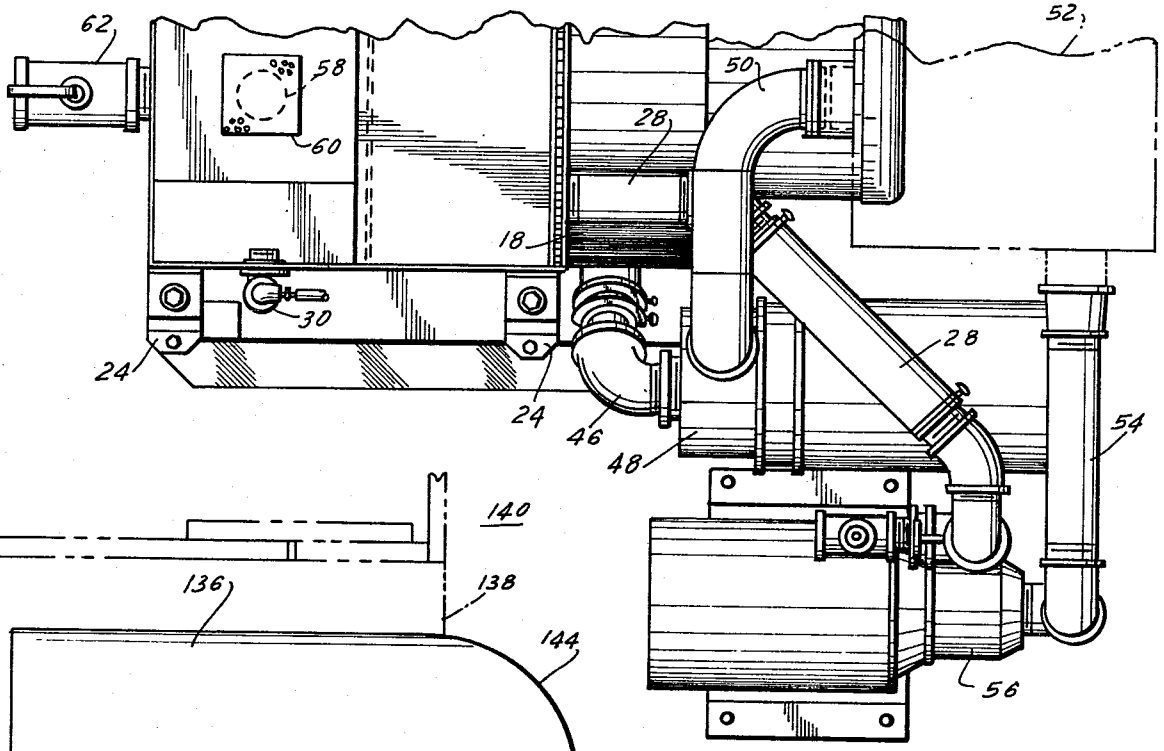
FIG. 3 is a top view of the apparatus shown in FIG. 1.

FIGS. 1–3 illustrate one embodiment of the invention. A waste pulping apparatus 10 including a rectangular pulping tank 12 with an extension 14 forming a housing for the impeller 16 and slurry chamber 18. The pulper is advantageously mounted on a frame or support structure 20 having a plurality of legs 22. Mechanical isolators 24 are provided for minimizing the effects of vibration due to cavitation. The isolators 24 may be commercially available products such as # CMA-130 or # CMA-60 from Barry Controls.

A fresh water pipe 26 is connected to the tank 12 for supplying fresh water thereto. A return pipe 28 supplies recycled water to the tank. The water level is maintained within desired limits by a water level control assembly 30.

A horizontal drive shaft 32 is connected at one end to drive motor 34 which is mounted to the housing in a conventional fashion. The other end of horizontal shaft 32 is fixed in position by bolt 36. Shaft 32 is rotatably mounted and journaled in position within the housing 14 and is mounted thereon for rotation with the impeller disc 16. The pulper is driven by a five horse power, three phase, sixty Hertz reversing motor secured at a 90° angle to the base plane.

A sieve 38 surrounds the impeller and has openings 40 of a predetermined size to permit passage of the pulp material when it has been reduced to the desired external size. The sieve is supported by a security ring 42 having openings 44 which allow the passage of water and pulped waste therethrough. The slurry chamber 18 receives the slurry and discharges it through a circuit 46 into a slurry pump 48. The slurry is pumped through a conduit 50 from the pump to an extractor 52.

The extractor is utilized for separating the liquid and solid components of the slurry. Liquid which is extracted flows through a pipe 54 to a return pump 56.

Recycled water is supplied by this pump to the tank 12 via pipe 28. A drain opening 58 having a screen 60 positioned thereover may be used for draining the tank when the apparatus is not in use. A drain pipe 62 is connected to the opening 58.

In operation, waste material is fed through an opening at the top of the pulping tank 12. It is mixed with a combination of fresh water from pipe 26 and recycled water from pipe 28. Once the solid material has been reduced to appropriate size by the impeller, the slurry passes through the sieve 38 and supporting ring 42 into the slurry chamber 18. The slurry will rotate within the chamber 18 due to the rotational movement of the impeller and the cylindrical configuration of the chamber walls. It passes into pipe 46 and is pumped to the extractor. Efficiency is maximized if the water level within the tank is maintained several inches below the top of the impeller.

Figure 4:
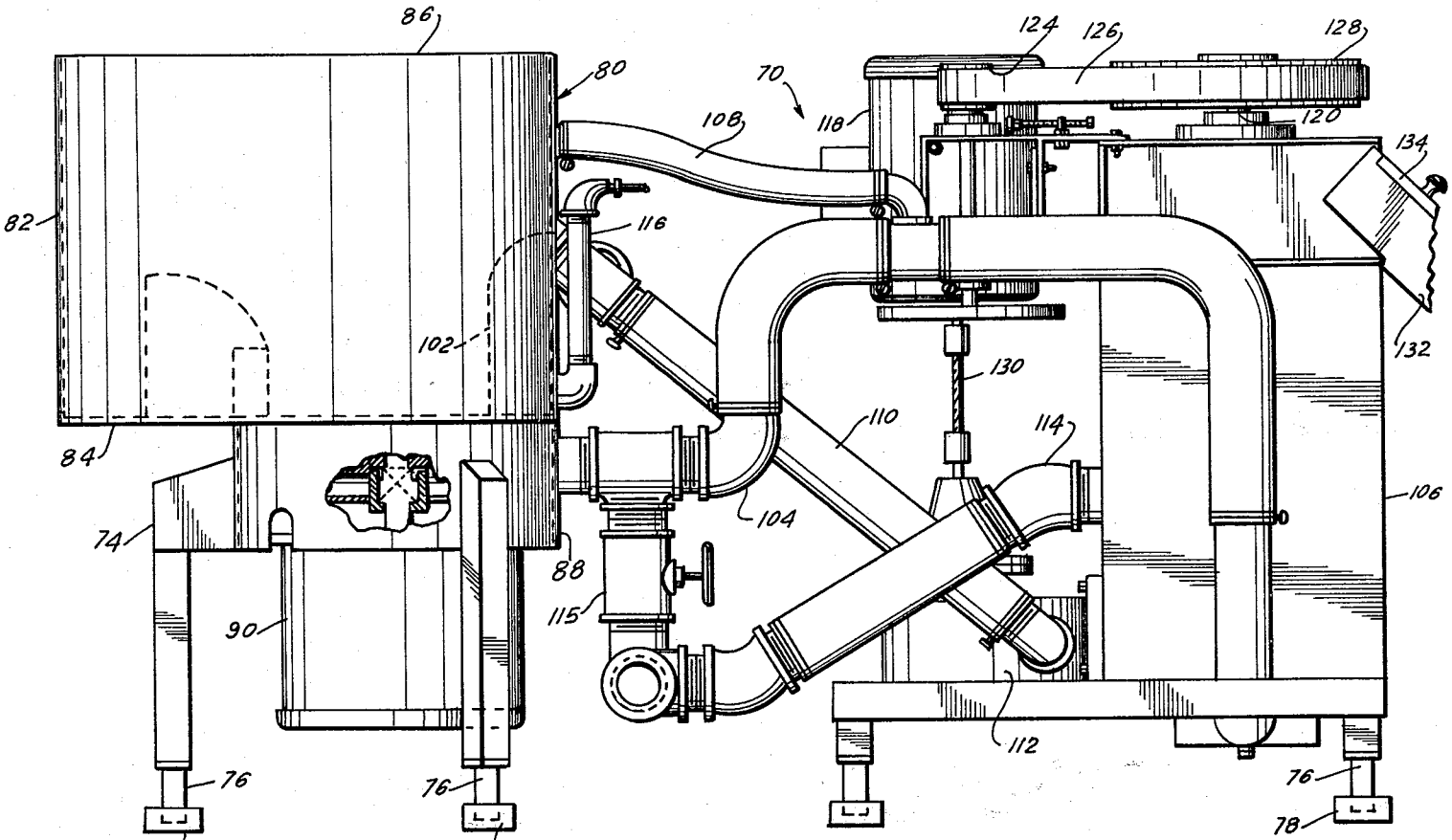
FIG. 4 is a side elevation view of a waste pulping apparatus having a horizontally disposed, off-center impeller.
Figure 5:
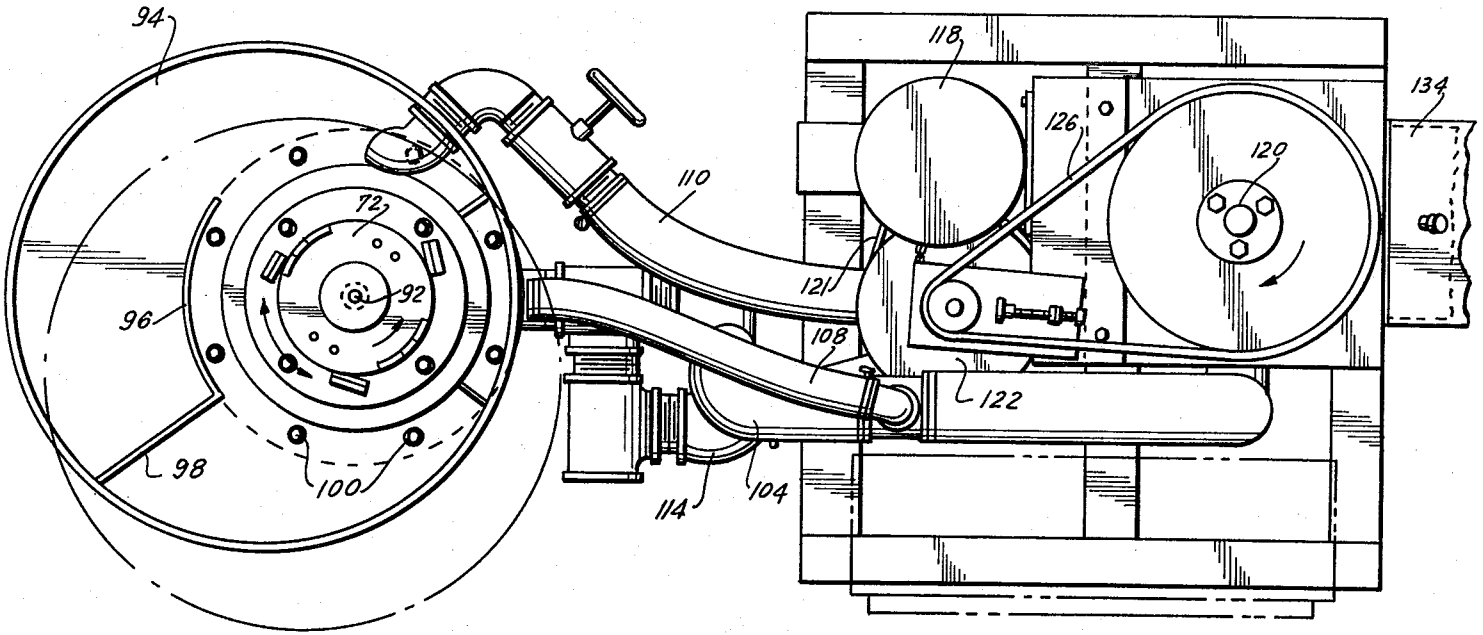
FIG. 5 is a top view of the apparatus shown in FIG. 4.

A second embodiment of the invention is shown in FIGS. 4 and 5. A waste pulping assembly 70 having a horizontally disposed impeller 72 is provided. Since vibration does not present as much of a problem in such pulpers, mechanical isolators or other shock absorbing means are not necessarily utilized.

The assembly 70 is mounted on a frame 74 having legs 76 with rubber feet 78. A cylindrical pulping tank 80 is provided having side walls 82, a bottom 84, and a top opening 86. A cylindrical slurry chamber 88 is positioned beneath the bottom of the tank and a motor 90 for driving the impeller is shown beneath the slurry chamber. The impeller 72 shown in FIG. 5 together with a sieve (not shown in FIGS. 4–5), separates the tank from the slurry chamber. A similar arrangement is disclosed, for example, in commonly assigned U.S. Pat. No. 3,885,745.

It is readily apparent from FIGS. 4–5 that the impeller shaft 92 about which the impeller 72 rotates is significantly off center from the vertical axis of symmetry of the cylindrical tank 80. This provides a relatively large area 94 on the opposite side of the impeller upon which waste material can be introduced without directly impinging upon the impeller. This is important as objects such as silverware or salt shakers mixed with the waste can damage the impeller if they contact it. By introducing them over area 94 where they may sink to the bottom of the tank and be trapped within shields 96, 98, damage to the impeller may be substantially avoided.

To further facilitate the introduction of waste material into the tank 80, the tank is rotatable about an axis defined by the center of the impeller 72. When the eight bolts 100 securing it to the slurry chamber 88 are loosened sufficiently or removed, the tank may be rotated eccentrically with respect to the chamber as shown in phantom in FIG. 5. Waste may then be introduced where it is most convenient for the operator.

Due to the rotational movement of the impeller, a vortex is created which draws the waste material and water to the impeller so that a slurry is produced. Baffles 102 may be provided to control the flow. When the waste material is of sufficiently small size, it is able to pass through the sieve into the slurry chamber. As in the previously described embodiment, the slurry within the chamber also rotates due to the impeller.

A slurry pipe 104 is connected to the slurry chamber. The pipe 104 allows slurry to flow horizontally, then vertically upwards, horizontally again, and then downwardly to the base of an extractor 106. The extractor may be similar to one described in commonly assigned Ser. No. 911,783 filed June 2, 1978, now U.S. Pat. No. 4,150,617. An air relief hose 108 is connected between the slurry pipe and the tank 80.

Water which has been separated from the solid portions of the waste is returned to the tank by a return pipe 110. A return pump 112 is provided near the bottom of the extractor for pumping the extracted water through the pipe 110. To prevent the water level within the extractor from being too high, an overflow pipe 114 is connected thereto. The overflow pipe is connected to the slurry pipe via valve 115. A water control assembly 116 is also provided to maintain the height of the water in the tank.

The same motor 118 is utilized for driving both the shaft 120 of the extractor and the return pump 112. A first belt 121 is connected between the motor 118 and a first flywheel 122. A shaft extends between the first flywheel and a second flywheel 124 so that they will rotate in unison. A second belt 126 extends between the second flywheel and a third flywheel 128 operatively connected to the shaft 120 of the extractor. The pump 112 is also operatively connected to the motor via flexible shaft coupling 130.

In operation, the waste material is reduced to a slurry in the pulping tank from where it passes through a sieve into the slurry chamber. The slurry flows through the slurry pipe 104 to an extractor 106. The liquid portion of the slurry is returned from the extractor to the tank via a return pump 112 and pipe 110. The solid portion of the waste exits the top of the extractor through a discharge chute 132 with a hinged cover 134.

Figure 6:
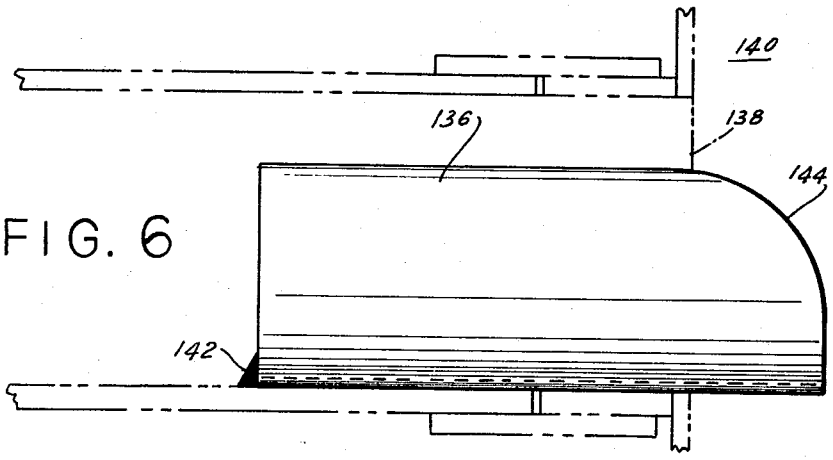
FIG. 6 is a side elevation view of part of a slurry chamber and slurry pipe with a scoop assembly for directing flow into the pipe.

To significantly increase throughput, the slurry tanks of both of the above-described machines are provided with a flow directing scoop 136 as shown in FIGS. 6 and 7. This element is positioned to cause the slurry flow to be deflected towards the orifice within the chamber defining the opening of the pipe 138. Such radial discharge is both simple and economical.

The shape and location of the scoop within the slurry chamber 140 are important as the scoop should not act as a significant obstruction. There are no sharp edges or corners where material can hang up. The circular cross-section of the scoop substantially matches the shape of the pipe 138 so that it may be welded thereto at 142, and extends from the orifice within the chamber defining the pipe opening. The amount of the extension should not be so great as to interfere with the operation of the impeller disc. Rotational flow within the slurry chamber should be into the open side of the U-shaped scoop which may be positioned perpendicularly to the chamber walls. The rounded outer edge 144 of the scoop is preferably the only portion extending into the chamber as materials will not tend to cling thereto. In a successful application of the invention, about one inch of the scoop extended into the chamber is shown in FIG. 6.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. An apparatus for pulping waste comprising:

a pulping tank adapted for holding a quantity of water and waste material and having an opening in a wall thereof;

an impeller extending across the opening in the tank and adapted for rotational movement to reduce water and waste material from said tank to a slurry;

a slurry chamber having substantially cylindrical side walls positioned behind the impeller and separated from the tank by said impeller and a sieve, the sieve allowing water and waste material reduced to a slurry by said impeller to enter the slurry chamber, the slurry within said slurry chamber capable of rotational movement when the impeller rotates;

a discharge opening within the slurry chamber through which the slurry may be removed and having an upstream and a downstream side relative to the direction of flow in said slurry chamber; and liquid deflecting means mounted within said slurry chamber adjacent the downstream side of the discharge opening and adapted for deflecting the slurry towards the discharge opening to increase throughput and pulping efficiency.

2. An apparatus as described in claim 1, wherein said liquid deflecting means is shaped as a scoop.

3. An apparatus as described in claim 2, wherein said scoop has a rounded edge portion and is mounted within said slurry chamber such that only the rounded edge portion extends therein from said opening.

4. An apparatus as described in claim 1, wherein said impeller is horizontally mounted within the opening in the tank.

5. An apparatus as described in claim 4, wherein the tank is defined by substantially symmetrical side walls and the axis of rotation of said impeller is offset from the axis of symmetry of said tank such that a relatively large area is created on one side of the tank where waste material may be introduced without directly impinging upon the impeller.

6. An apparatus as described in claim 5, wherein said side walls are substantially cylindrical.

7. An apparatus as described in claim 1, wherein said impeller is vertically mounted within the opening in the tank.

8. An apparatus as described in claim 7, wherein said tank is mounted upon shock absorbing means adapted for reducing the effects of vibration of said apparatus.

9. An apparatus for pulping waste comprising:

a pulping tank having substantially symmetrical side walls and adapted for holding a quantity of water and waste material;

an upper opening towards the top of the tank for allowing the introduction of waste material therein and a bottom opening in the bottom of the tank;

an impeller mounted across the bottom opening of the tank for reducing water and waste material to a slurry, the rotational axis of the impeller being positioned off-center relative to the axis of the tank for creating a relatively large bottom area on one side of the tank upon which waste material may be introduced to the tank without directly impinging upon the impeller, thereby permitting the introduction of objects in the waste material that should be free from action of the impeller; and a substantially cylindrical slurry chamber is positioned beneath said impeller, said tank being mounted eccentrically with respect to said slurry chamber, the slurry chamber having substantially cylindrical side walls positioned behind the impeller and separated from the tank by said impeller and a sieve, the sieve allowing water and waste material reduced to a slurry by said impeller to enter the slurry chamber.

10. An apparatus as described in claim 9, wherein said side walls define an opening at the top of the tank.

11. An apparatus as described in claim 10, wherein a shield is provided near the top of the tank for preventing waste material from directly impinging upon the impeller.

12. An apparatus as described in claim 9, wherein a shield is provided at the bottom of the tank for restricting the movement of non-pulpable material such as silverware towards the impeller.

13. An apparatus as described in claim 9, wherein said side walls are substantially cylindrical.

14. An apparatus as described in claim 13, wherein said tank is rotatable with respect to said slurry chamber.

* * * * *